United States Patent [19]

LaMont

[11] 4,185,398

[45] Jan. 29, 1980

[54] AIR-FLOW WIG DRYER/HOLDER AND METHOD OF MANUFACTURE

[76] Inventor: Romanus M. LaMont, Box F3, Wickenburg, Ariz. 85358

[21] Appl. No.: 850,277

[22] Filed: Nov. 10, 1977

[51] Int. Cl.[2] ..... A45D 20/24

[52] U.S. Cl. ..... 34/103; 264/328

[58] Field of Search ..... 264/328, 329; 34/103, 34/104, 239, 3

[56] References Cited

U.S. PATENT DOCUMENTS

| | | | |
|---|---|---|---|
| 2,687,157 | 8/1954 | Cowan | 264/328 UX |
| 3,309,451 | 3/1967 | Holtzman | 264/328 X |
| 3,662,574 | 5/1972 | Groat | 34/103 X |
| 3,701,821 | 10/1972 | Barnes | 264/328 X |
| 3,757,429 | 9/1973 | Sumino | 34/103 |

*Primary Examiner*—Andrew V. Kundrat

*Attorney, Agent, or Firm*—Cahill, Sutton & Thomas

[57] ABSTRACT

A polypropylene wig supporting framework and method of manufacture. The wig drying framework includes two symmetrical frameworks each shaped somewhat like half of a human head. Each of the symmetrial frameworks includes an integral half-elbow member and two integral support members. The two symmetrical frameworks are connected by means of a thin polypropylene hinge strap approximately 40 mils in thickness. Each symmetrical framework includes a plurality of spaced vertical and lateral members which are integrally joined at intersections thereof. Each symmetrical framework includes a plurality of integral fastening members which may be aligned and snapped together to fasten the two symmetrical frameworks together to provide a single head-shaped wig supporting framework and associated supporting members. The fastening members include rigid "tongue" members and "hinge" members having small openings therein to snap over ends of "tongue" members. The tongue members and hinge members engaged thereto are located on opposite ones of the symmetrical frameworks so that the tongue and hinge members are aligned when the two symmetrical frameworks are properly aligned. The hinge members are each integrally connected to the symmetrical frameworks by means of thin polypropylene strips approximately 40 mils in thickness. The polypropylene wig supporting framework is manufactured by preheating polypropylene molding material to approximately 450° F., and injecting it into an injection mold having a single continuous cavity which defines the entire shapes of the two symmetrical frameworks, half elbow members, support members, fastening members, and the hinge strap. The resulting wig drying framework is inexpensive, and easy to ship, assemble, and utilize.

18 Claims, 7 Drawing Figures

AIR-FLOW WIG DRYER/HOLDER AND METHOD OF MANUFACTURE

BACKGROUND OF THE INVENTION

1. Field of the Invention

The invention relates to wig supporting and drying apparatus and method of manufacture.

2. Description of the Prior Art

A variety of wig supporting and drying devices are known in the prior art. Some merely include solid head-shaped support blocks on which a wig may be placed. Materials such as Styrofoam or cork have been utilized so that the wig may be pinned thereto. However, the inner support material of wigs mounted on such solid blocks does not dry efficiently because of the lack of air circulation to transport the moist air away. Other types of wig drying devices include hollow head-shaped supporting structures having holes disposed along the wig supporting surface, so that hot air may be forced from within such structures through the wig material to improve the drying rate. These device have often required electrical heating elements and blowers to heat air and force it through the wig. The known solid wig drying supports and the blowers are bulky and uneconomical to transport. Many are quite expensive, especially those which utilize integral electrical blowers. There is a need for an inexpensive wig and supporting and drying structure which maintains the shape of a wig during storing or drying, and which allows a wig to dry rapidly, even without the use of a blower or heater, and which may be shipped in large quantities without requiring unduly large and expensive shipping containers.

The state of the art is generally indicated by U.S. Pat. Nos. 3,958,340; 3,501,847; 3,662,574; 3,188,752; 3,320,681; 3,726,022; 3,757,429; and 3,819,930.

SUMMARY OF THE INVENTION

Accordingly, it is an object of the invention to provide an inexpensive wig supporting and drying apparatus.

It is another object of the invention to provide a wig drying form which permits effective drying of both the outer side and the under side of a wig placed on the wig drying form.

It is another object of the invention to provide a wig drying form which is easily and inexpensively manufacturable.

It is yet another object of the invention to provide a wig drying form which may be conveniently packaged for transporting.

It is another object of the invention to provide a wig drying form which minimizes contact area between the underside of a wig and support members of the wig drying form, in order to improve air circulation near the contact areas.

It is another object of the invention to provide an inexpensive wig drying form which may either receive air produced by a blower to improve the drying rate or be effectively used as a stand-alone wig drying device which permits efficient drying of the outer and under portions of a wig without use of a blower.

Briefly described, and in accordance with one embodiment thereof, the invention provides a wig supporting/drying form, hereinafter referred to as a wig drying form, and an economical method of manufacture. The wig drying form includes first and second substantially symmetrical frameworks shaped substantially like half a human head. Each framework includes a plurality of thin longitudinal and vertical structural members having substantially triangular cross-sections which are integrally joined at various intersections thereof. Each of the symmetrical frameworks includes an elbow-like member and supporting members integral with the elbow-like member. The two symmetrical frameworks are hinged together by a thin polypropylene hinge strap formed integrally with the rest of the wig drying structure. Each of the symmetrical frameworks includes a plurality of fastening members which may be aligned and snapped together so that the symmetrical frameworks perform a complete head-shaped wig supporting framework and associated support members. Suction cups may be attached to the support members so that the wig drying form may be firmly attached to a smooth surface. Except for the suction cups, the entire structure is formed from polypropylene in a single injection molding operation. The injection molding process includes heating a quantity of polypropylene molding substance to approximately 450° F. and injecting it at a pressure of approximately 800 pounds per square inch into an injection molding apparatus having a single continuous cavity which defines both symmetrical frameworks, fastening members, elbow-like members, and support members. The injected polypropylene molding material is allowed to cool. The injection molding apparatus is then opened, and the one-piece wig supporting/drying form is removed. A large number of such wig drying forms may be stacked, one within the other, for shipping. The symmetrical frameworks may be assembled by the user by closing the two symmetrical frameworks, engaging the fastening members, and attaching the suction cups to the support members.

DESCRIPTION OF THE INVENTION

Figure 1:
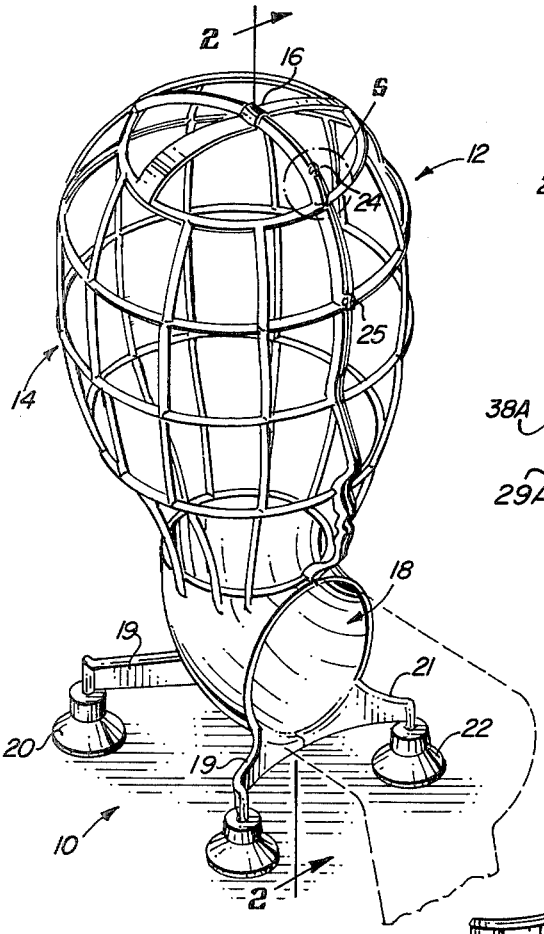
FIG. 1 is a perspective drawing of the assembled wig drying form of the invention.
Figures 5, 6, 7:
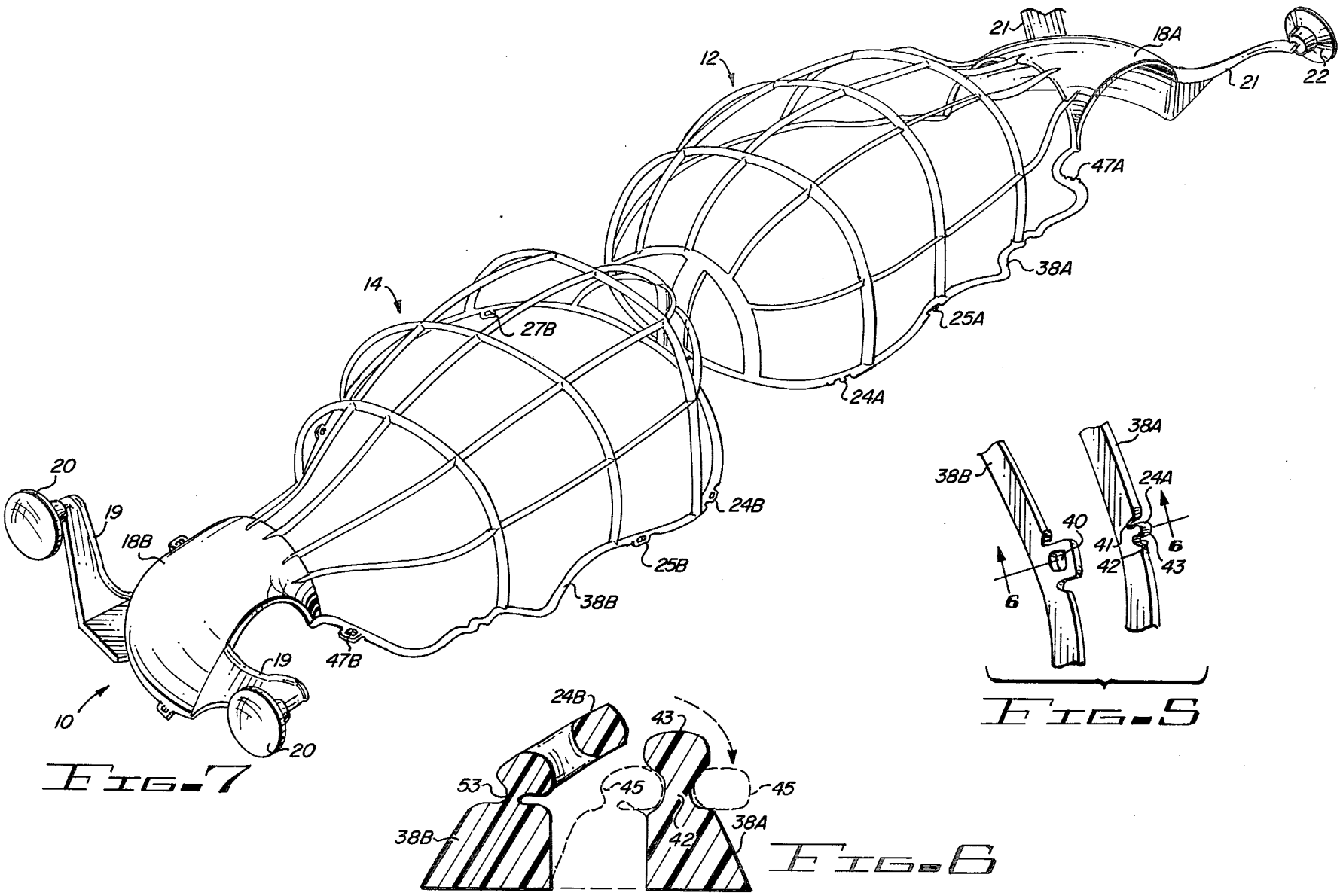
FIG. 5 illustrates one fastener which fastens the two symmetrical sections of the wig drying form together as shown in FIG. 1.
FIG. 6 is a partial sectional view of the fastener of FIG. 5 taken along section lines 6—6 thereof.
FIG. 7 is a perspective drawing showing the entire wig drying form of FIG. 1 in open or unassembled form.

The wig drying form or framework of the invention is shown in assembled form in FIG. 1. Wig drying form 10 includes a head-shaped framework including two symmetrical half-frames 12 and 14 which are folded together. The complete device shown in its "open" or unassembled form is shown in FIG. 7. Referring to the drawings, especially to FIGS. 1 and 7, it is seen that half-frames 12 and 14 are each "ribbed" structures having a plurality of "horizontal" members or struts and a plurality of "vertical" members or struts which are integrally joined at various intersections to approximately outline one-half of a human head.

As shown in FIGS. 1 and 7, an elbow-like section 18 includes sections 18A and 18B integrally formed with symmetrical half-frames 12 and 14, respectively. Lateral support arms 19 are formed integrally with elbow member 18B and lateral support arms 21 are formed integrally with elbow member 18A. Suction cups such as 20, 22 are attached to protrusions of the lateral support arms.

The entire wig drying apparatus, exclusive of the suction cups, is formed from polypropylene by an injection molding process, as subsequently described. The suction cups may be any suitable substance, such as vinal, rubber, or various other petrochemical products; they may be formed by an injection molding process.

Figure 2:
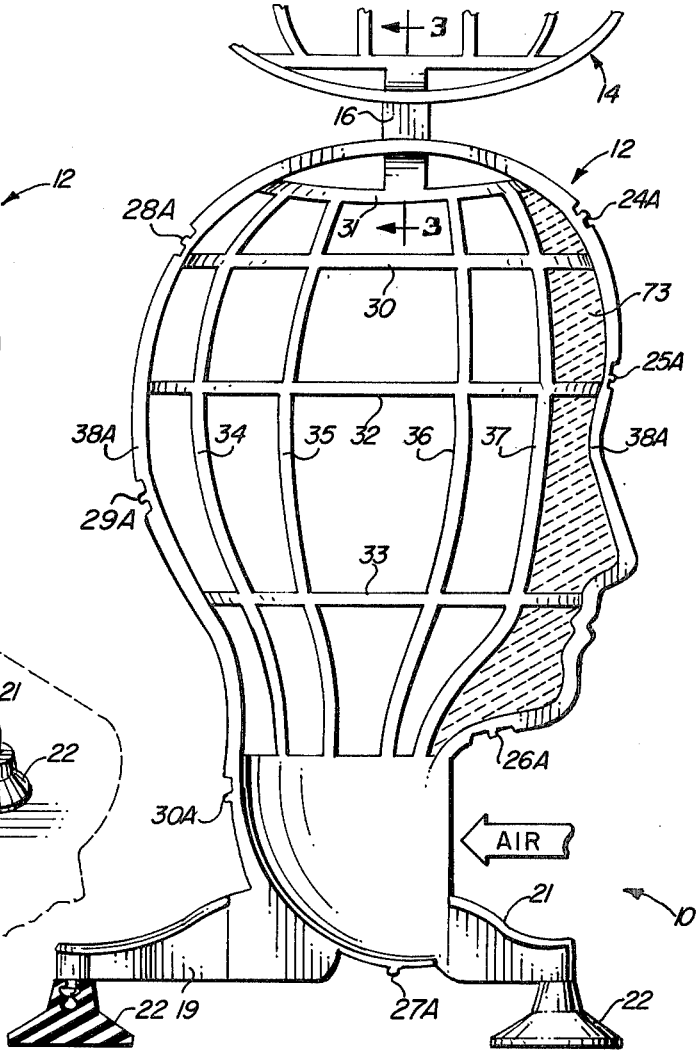
FIG. 2 shows a view of the wig drying form taken along section lines 2—2 of FIG. 1.

Referring to FIG. 2, the above-mentioned horizontal members include members 31, 30, 32, and 33 in symmetrical half-frame 12; corresponding members are shown in half-frame 14, but are not designated by reference numerals.

Figure 4:
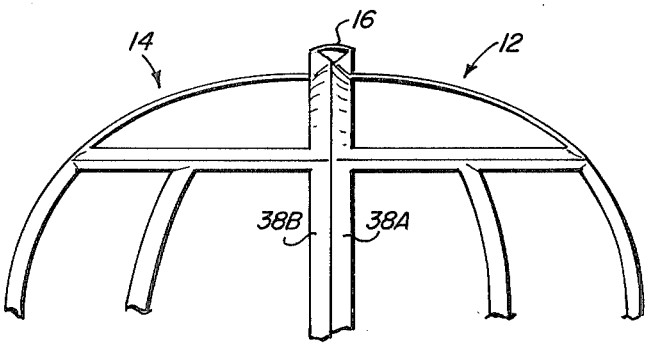
FIG. 4 shows a partial view of the wig drying form as it would appear along section lines 3—3 in FIG. 2 when the wig drying form is assembled as in FIG. 1.

Referring to FIGS. 1, 2, and 7, it is seen that a plurality of "fasteners" are integrally molded with interface members 38A and 38B. The fastening members may be engaged or "snapped together" to maintain the wig drying form in the assembled configuration of FIG. 1. Interface members 38A and 38B have substantially planar surfaces whereat the symmetrical sections uniformly adjoin each other as they are bent about hinge strap 16, as indicated in FIG. 4. Hinge strap 16 is preferably approximately 40 mils (i.e., forty thousandths of an inch) in thickness. It is well known to those skilled in the art that polypropylene of this thickness provides a very reliable hinge.

Reference numerals 24 and 25 in FIG. 1 show two such fastening devices. The fastening devices are located in spaced relationship around interface members 38A and 38B and also at the interfacing edges of elbow-like members 18A and 18B, as shown by reference numerals 24A, 25A, 26A, 27A, 28A, 29A, and 30A in FIG. 2.

Each of the fastening devices includes a "tongue" member and a "hinge" member as shown in FIG. 5. FIG. 5 illustrates the components of fastening device 24 of FIG 1 in enlarged detail. Fastening device 24 includes tongue member 24A formed integrally with interface member 38A and extending from a recessed region 41 thereof. Tongue member 24A includes a somewhat enlarged head 43 and a relatively narrow neck portion 42. The member includes a slot 40 formed in a "ring" of polypropylene integrally formed with interface member 38B. Slot 40 is sufficiently large to accommodate head 43 of tongue member 24A if sufficient pressure is applied to force head 43 through slot 40, as depicted in FIG. 6. The dotted lines 45 in FIG. 6 illustrate the manner in which hinge member 24B is "snapped" over head 43 to engage fastening member 24.

As may be seen from FIG. 7, the various fastening devices have their corresponding hinge and tongue members so aligned that when symmetrical half-frames 12 and 14 are "closed together," the slots of the wing members and the corresponding tongue members are aligned so that they may be snapped together to form a rigid hair drying apparatus.

Figure 3:
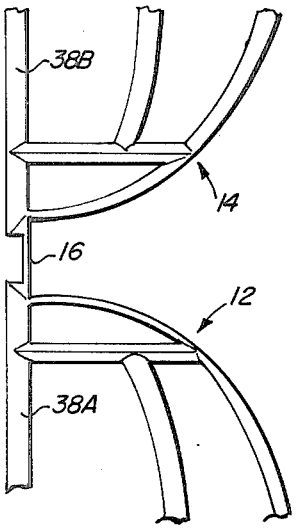
FIG. 3 shows a partial view of the wig drying form taken along section lines 3—3 of FIG. 2.

The structure of hinge strap 16 is clearly shown from FIGS. 2, 3, and 4.

The suction cups 20 may be pressed on to a smooth surface, such as a top of a vanity or table, to maintain the wig drying apparatus and wig thereon firmly in a fixed position, so that the wig may be combed or otherwise handled. The wig may be firmly fixed to the wig supporting member by means of pins, bobby pins, etc., which pass through the wig to engage a cross member or any of the other horizontal and vertical structural members.

As shown in FIG. 2, air may be forced into the open end of elbow member 18. A dryer nozzel, as indicated by dotted lines, may be inserted into opening 18 to direct air therein. The air will then be deflected into the interior of the structure by the inner curved portion of elbow-like member 18 thereby causing rapid drying of the inner portions of a wig mounted on wig drying form 10.

If forced air is utilized to assist in drying the wig attached to wig drying apparatus 10, it may be desirable to provide a thin integral sheet of polypropylene, such as that indicated by reference numeral 73 in FIG. 2, between lateral and vertical support members of the "face" portion of the wig supporting form in order to prevent loss of the forced air through the face region, thereby causing most of the air to be forced through the wig. However, it is not necessary that forced air be utilized; if forced air is not used, the thin sheet of polypropylene over the face area should be omitted, allowing free circulation of air in and out of the "face" portion of the structure, so that moist air resulting from evaporation of the inside portion of the wig may be easily transported away from the interior portion of the structure through the openings in the face region and so that dry outside air can be transported inward through the same openings by normal air circulation, thereby hastening the drying of the underside of the wig. If forced air is not utilized, it is not necessary that section 18 be elbow shaped, since the elbow shaped configuration is utilized to accommodate cooperation with the air blower.

As previously mentioned, the wig drying form of FIGS. 1–7 is a single unit formed by injection molding of polypropylene molding material (except for the suction cups). Polypropylene molding material is utilized because of its "hingability" characteristics, for "hinge strips" approximately 40 mils in thickness; the 40 mil hinges may be flexed thousands of times without being significantly weakened. Yet, thicker members of polypropylene have the substantially rigid characteristics required for the various other members of the wig drying form.

It should be noted that the various vertical and horizontal members of the wig drying form have triangular cross-sections. This minimizes the area of contact between the wig drying form and the wig, thereby improving air circulation through the wig near such contact areas. Consquently, the drying efficiency is improved.

Polypropylene is more flame resistant than the styrofoam commonly used for solid wig drying forms, and is also more resilient; it may be bent, but will spring back into its initial shape when the distorting pressure is released.

It should be noted that all of the thin "hinge" portions of hinge members such as 24B of FIG. 6 and 47B, 25B, 24B, etc., of FIG. 7, are approximately 40 mils thick, although thicknesses in the range from 15 mils to 50 mils may be utilized, depending upon the tensile stresses likely to be applied thereto.

According to the injection molding method of the invention, an injection molding apparatus, when closed, provides a single continuous cavity which has the configuration shown in FIG. 7 minus the suction cups. The injection molding apparatus is preferrably formed from steel. The polypropylene molding substance is readily commercially available; for example, it may be obtained under the trademark "Pro-Fax" from Hercules, Incorporated, a subsidiary of Exxon. A number of other petroleum companies, including Shell Oil Company, also supply polypropylene molding materials.

The polypropylene is heated to approximately 450° F. and is then injected at a pressure of approximately 800 pounds per square inch into the continuous cavity of the closed injection mold. (Temperatures in the range from 400° to 500° F. and pressures from 600 to 1200 pounds per square inch may be suitable.) The injection molding process is quite conventional, as is the general configuration of the injection molding apparatus; the details may be readily implemented by one of ordinary skill in the art. After four or five seconds of injection at the above temperature and pressure, the continuous cavity of the mold is completely filled. The steel mold, initially at room temperature, is heated primarily by heat from the injected polypropylene molding material; consequently, after a relatively short time, of approximately 10 seconds or so, the polypropylene molding substance is cool enough to become sufficiently "set" to permit opening of the injection molding apparatus without damage to the resulting wig drying form. The wig supporting apparatus may then be removed; it will appear as shown in FIG. 7 (minus the suction cups).

Of course, the above temperature, pressure, and times may be varied somewhat, as desired by the manufacturer, to accommodate differences in molding materials, molding equipment, and characteristics of the resulting wig drying form.

I claim:

1. A method of manufacturing a wig supporting form comprising the steps of:

(a) heating a quantity of polypropylene molding substance to a temperature sufficiently high to permit injection molding of said polypropylene molding substance;

(b) closing an injection molding apparatus to provide a mold for forming first and second substantially symmetrical frames each having corresponding fastening members engageable to fasten said first and second frames together to form a wig supporting frame and base thereof, first and second base members being formed integrally with said first and second substantially symmetrical frames;

(c) injecting a sufficient amount of said heated polypropylene molding substance into said mold to fill said mold;

(d) allowing said injected polypropylene molding substance to cool to a temperature sufficiently low to allow opening said injection molding apparatus without damage to said wig drying form;

(e) opening said injection molding apparatus;

(f) removing said wig drying form from said injection molding apparatus;

(g) aligning said first and second frames;

(h) engaging said corresponding fastening members to provide said wig supporting form; and (i) attaching a plurality of suction cups to said base members.

2. The method of claim 1 wherein said polypropylene molding substance is heated to a temperature approximately in the range from 400 to 500 degrees Fahrenheit.

3. The method of claim 1 wherein said injecting is performed at a pressure approximately in the range from 600 to 1200 pounds per square inch.

4. The method of claim 1 wherein said quantity of polypropylene molding substance is heated to approximately 450 degree Fahrenheit.

5. The method of claim 1 wherein said injecting is performed at a pressure of approximately eight hundred pounds per square inch.

6. The method of claim 1 wherein said first and second base members fit together to form an elbow-like tubular section for receiving air from a blower and deflecting the air upward into the interior of said spherical wig supporting form when said substantially symmetrical frames are joined and fastened together.

7. The method of claim 1 wherein said first and second base members each include two laterally extending support members for receiving said suction cups.

8. The method of claim 1 wherein said mold has a single continuous cavity forming said first and second substantially symmetrical frames, said base members, and said fastening members.

9. The method of claim 8 wherein two of said corresponding fastening members include a rigid extension of polypropylene material integrally formed with one of said substantially symmetrical frameworks and an aligned hinged member integral with the other symmetrical framework, the hinged member having an opening therein which is sufficiently small to permit snapping of said hinge member over said corresponding extension.

10. The method of claim 9 wherein said first and second substantially symmetrical sections are hinged together by means of a thin, integrally formed hinged member.

11. The method of claim 10 wherein said hinge members of said fastening members and said thin hinge strap have hinging portions with thicknesses in the range from 15 to 50 thousandths of an inch.

12. A polypropylene wig supporting form comprising in combination:

(a) first and second approximately symmetrical frameworks hinged together to form a unitary body, each of said frameworks including a plurality of approximately horizontal strut members and a plurality of approximately vertical strut members integrally joined together at a plurality of intersections thereof, thereby outlining a shape approximately similar to the shape of half of a human head;

(b) said first framework including a first interface strut member having a first substantially planar surface thereof formed by a pair of opposite ones of said approximately vertical strut members and bounding said first framework;

(c) said second framework including a second interface strut member having a second substantially planar surface thereof formed by a pair of opposite ones of said approximately vertical strut members and bounding said second framework;

(d) a thin hinged strap member formed integrally with said first and second interface strut members for hinging said first and second frameworks together to permit closing of said first and second frameworks so that said first and second substantially planar surfaces adjoin and are align with said first and second frameworks to outline a shape approximately similar to the shape of a human head;

(e) a plurality of first fastening members disposed in spaced relationship along said first interface strut member;

(f) a plurality of second fastening members disposed in spaced relationship along said second interface strut member in such that said first fastening members and said second fastening members are engagably aligned when said wig supporting form is closed, whereby said respective first fastening members and said second fastening members may be engaged to rigidly maintain said wig supporting form in its closed configuration; and (g) first and second base members integrally formed with said first and second frameworks, respectively, for providing a base for said wig supporting form and further including suction cups attached to said first and second base members for attaching said polypropylene wig supporting form to a smooth surface.

13. The polypropylene wig supporting form of claim 12 formed by injection molding.

14. The polypropylene wig supporting form of claim 13 wherein said approximately horizontal strut members and said approximately vertical strut members have approximately triangular cross-sectins thereof to minimize the area of contact between said approximately horizontal strut members and said approximately vertical strut members and the underside of a wig mounted on said polypropylene supporting form, thereby improving air circulation or flow proximate to the area of contact and improve the rate of drying of the wig proximate to the area of contact.

15. The polypropylene wig supporting form of claim 13 wherein said thin hinge strap member has a thickness in the range from 15 to 50 thousandths of an inch to provide reliable hinging action thereof.

16. The polypropylene wig supporting form of claim 13 wherein said first fastening members include a plurality of hinged tongue members each having an enlarged end and wherein said second fastening members include a plurality of hinged members each having an opening therein, each of said openings being sufficiently large to be snapped over said enlarged ends to firmly engage said tongue members.

17. The polypropylene wig supporting form of claim 16 wherein said hinged tongue members and said hinged members each include hinge portions thereof having thicknesses in the range from 15 to 50 thousandths of an inch to provide reliable hinging action.

18. The polypropylene wig supporting form of claim 12 further including thin sheet-like members of polypropylene formed integrally with said approximately horizontal and vertical strut members covering a portion of said polypropylene wig supporting form corresponding to a face portion thereof not covered by a wig mounted on said polypropylene wig supporting form, thereby preventing escaping of said deflected air through the face portion of said wig supporting form and thereby forcing said deflected air through a wig mounted on said wig supporting form, thereby effecting more rapid drying of said wig.

* * * * *